United States Patent [19]

Lerner et al.

[11] Patent Number: 4,682,670

[45] Date of Patent: Jul. 28, 1987

[54] PORTABLE ADJUSTABLE ACOUSTIC ABSORBER

[75] Inventors: Lawrence Lerner, Beverly Hills; Stephen P. Diskin, Los Angeles, both of Calif.

[73] Assignee: Mega/ERG, Incorporated, Beverly Hills, Calif.

[21] Appl. No.: 890,813

[22] Filed: Jul. 28, 1986

[51] Int. Cl.[4] ..... E04B 1/82

[52] U.S. Cl. ..... 181/287; 181/295

[58] Field of Search ..... 181/284, 287, 295, 210

[56] References Cited

U.S. PATENT DOCUMENTS

| | | | |
|---|---|---|---|
| 3,578,105 | 5/1977 | Grigg | 181/295 |
| 3,712,413 | 1/1976 | Eckel | 181/295 |
| 3,735,837 | 5/1973 | Duda et al. | 181/295 |
| 3,786,898 | 1/1974 | Fujii | 181/295 |
| 4,122,915 | 10/1978 | Tagachi | 181/284 |
| 4,193,474 | 3/1980 | Okubo et al. | 181/287 |
| 4,387,786 | 6/1983 | Klipsch et al. | 181/295 X |

*Primary Examiner*—Benjamin R. Fuller

[57] ABSTRACT

A portable acoustic absorber system which can be used in particular in open office environments or in large spaces with unwanted echoes or excessive noise. The device operates by supporting and arraying panels of efficient sound absorbing materials in a helical configuration in which a majority of the surface area of those panels is exposed. During shipping, or when the device is not in use, it can be reconfigured into a closed position, which occupies much less space.

4 Claims, 6 Drawing Figures

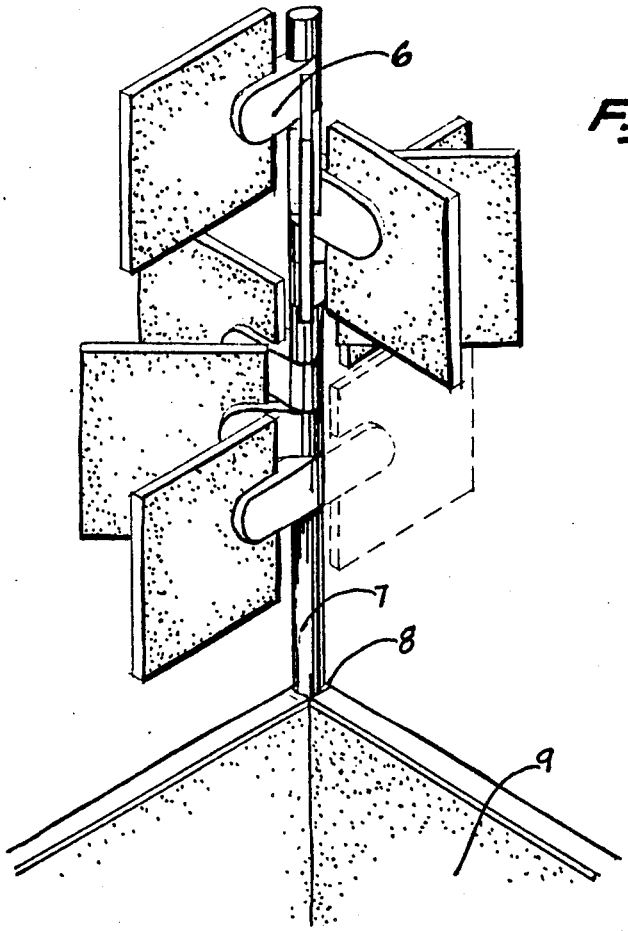
Fig. 4
Fig. 5
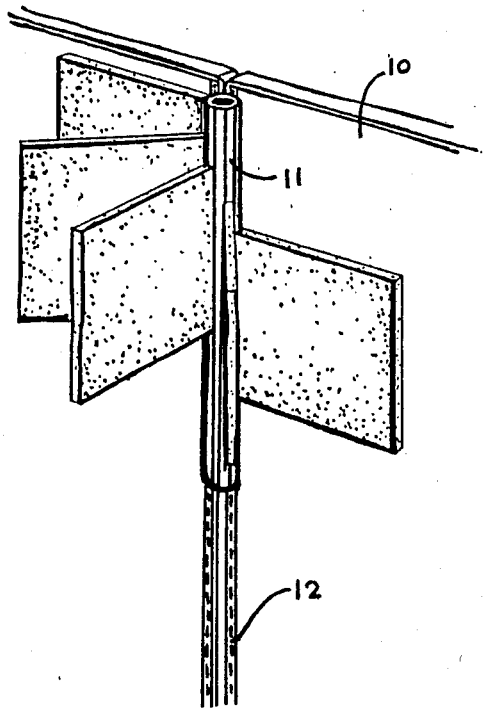
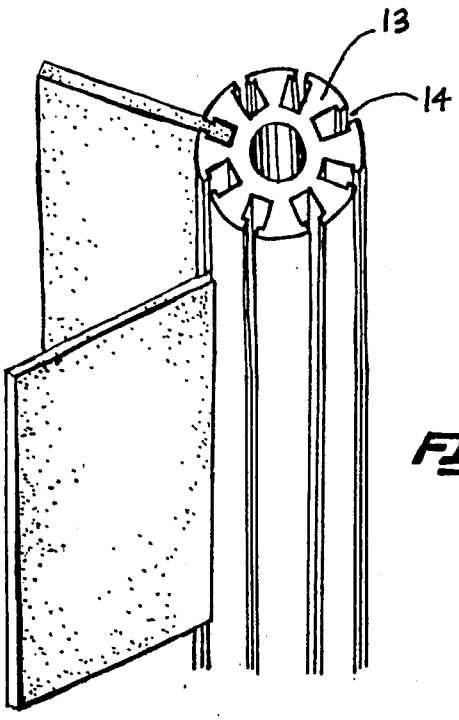
Fig. 6

PORTABLE ADJUSTABLE ACOUSTIC ABSORBER

BACKGROUND OF THE INVENTION

The open-plan office has brought with it the need for acoustic privacy. Although many existing partition systems offer easily configured visual shielding, they do not always provide an equivalent amount of acoustic shielding. The conventional solution to excessive noise is the standard suspended ceiling panel of absorptive material. It is fixed in place and only of very limited use in certain cases. Often, additional absorptive material must be added to a space to reduce reverberation and noise. Modern acoustical principles suggest also that the additional absorptive material be strategically located at or near the source of the annoying sound.

At present, no system exists for providing strategically located absorptive panels in workspaces without expensive contractors or physical alteration of existing ceiling or wall surfaces. The present device is developed as a solution to this problem. It is meant to be a self-contained unit, many of which could be distributed throughout a space as needed. In its closed form, it would contain a multiplicity of absorbing panels arranged in a dense, closely-packed, volume-efficient configuration. When opened to its in-use position, it would array the same number of absorbent panels into a configuration meant to expose the greatest amount of surface area to absorb sound. The device can be supported on its own base, attached to a vertical wall surface or adapted readily to mount in various ways on typical workstation partition systems. The device therefore is useful in controlling sound in many different locations without taking up large areas when not in use or when being shipped. Panels of absorbent material would be easily replaceable, or the panels of different manufacturers could be adapted easily since they are normally of modular dimensions.

A helical arrangement of sound absorbing panels, either vertically or horizontally arrayed accomplishes this result. This helical arrangement is unique in that it provides ease of assembly and disposition and an alternating distribution of absorbent panels and air spaces or gaps to maximize absorption when in its open position, and then rotates into a compact shape when not in use, or dissassembles quickly and individual panels may then be stacked away efficiently.

SUMMARY OF THE INVENTION

The present invention is meant to provide a portable sound absorbing unit which may be opened for maximum absorption of sound, or closed to fit in a relatively small volume. To achieve this purpose, it is provided with a base means adaptable to floor wall, or partition mounting, and various support means for modular sound absorbent panels capable of being arrayed into a configuration characterizing a helical shape in a regular pattern which exposes a substantial amount of the absorbent surface of each panel with airspace gaps in between.

The primary object of the invention is that it be a portable self contained unit, any number of which can be brought into a noisy space to absorb unwanted sounds.

Another object of the invention is to utilize drop-in modular sound absorbent panels from any manufacturer and support and configure them to absorb sound.

Another object of the invention is to be able to pack and ship the unit in its most volumetrically compact form.

Another object of the invention is to support sound absorbent panels with a minimum of structure in such a way that when the unit is in use, these panels expose a substantial portion of their surface area for sound absorption by means of regular spacing.

Another object of the invention is to be able to retrofit the device in an existing noisy workspace without intervention to construction tradesmen or without permanent alteration of interior enclosure surfaces.

Another object of the invention is adaptability for mounting to partition systems of various manufacturers.

BRIEF DESCRIPTION OF THE DRAWINGS

FIG. 4 is a perspective of a modified form of the device wherein panels are arranged vertically and the entire device has been mounted atop a typical office partition.

FIG. 5 shows a perspective of a partial device attached to a typical partition via connection to built-in slotted standards in the partition, with specially-adapted hardware, with the device radiating through an angle of 180 degrees.

FIG. 6 is a detail of the central shaft in one embodiment of the device wherein the shaft is designed to accept sound absorbent panels inserted into slots along the axis of the shaft.

DETAILED DESCRIPTION OF THE DRAWINGS

The present invention is described in one of its preferred embodiments as a pedestal mounted helical portable sound absorber; however, it should be noted that other embodiments utilizing the invention as claimed are contemplated, which would include, for example, workstation partition and wall surface mounted absorbers with fixed and rotating panel connectors of various types depending on the size, rigidity, and nature of the sound absorbing panel being used.

Figure 1:
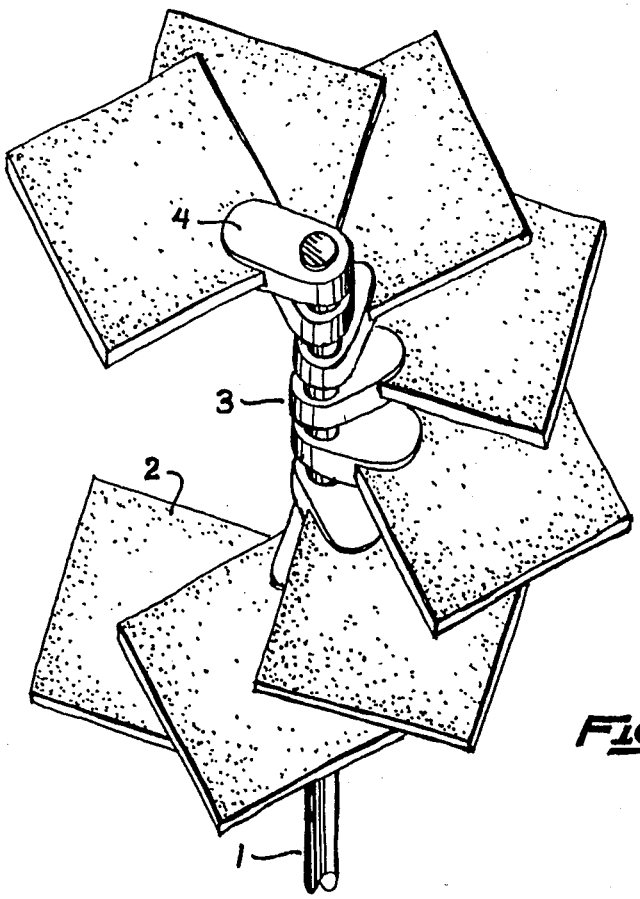
FIG. 1 is a perspective view of a portable sound absorber.

In the present invention, refering to FIG. 1, numeral one (1) indicates a central shaft member which supports the assembly of sound absorbing panels (2). This shaft may be made available in several lengths to accomodate a given number of absorber panels. For example, where ceiling height permits, a tall shaft mounted vertically may be able to hold many absorptive panels, where a short shaft may be mounted perpendicularly to a wall surface and hold a small number of panels. Absorbent panels (2) are made of materials suited to absorption of sound: particularly, glass fiber, mineral fiber, foamed plastics of appropriate densities or a combination or lamination of these materials. In addition, panels may contain a structurally reinforced layer such that the panel may be feasibly cantilevered through edge or corner support only. This is done to avoid having to use a very large connecting means which would itself interfere with the sound absorbing properties of the panels. Panels are fixed to the central shaft via connecting means (3) designed to allow simple insertion and support of panels in various positions, but basically in a cantilevered fashion. The connector may be adjustable to hold panels of different thicknesses by different manufacturers, or custom made panels for use in this device only.

Figure 2:
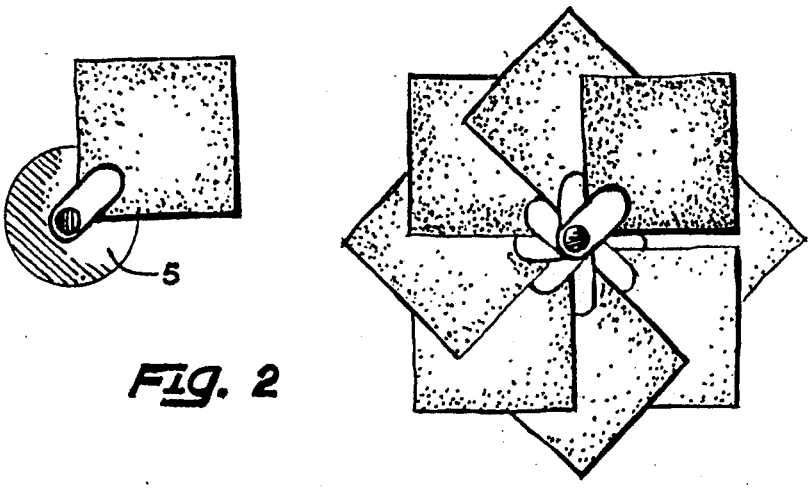
FIG. 2 is a plan view of the entire invention, showing the device in its closed configuration in the left side of the figure as if the device had just been unpacked or in a form to be carried. The right hand portion shows a plan view of the device in its opened form, as if in use.
Figure 3:
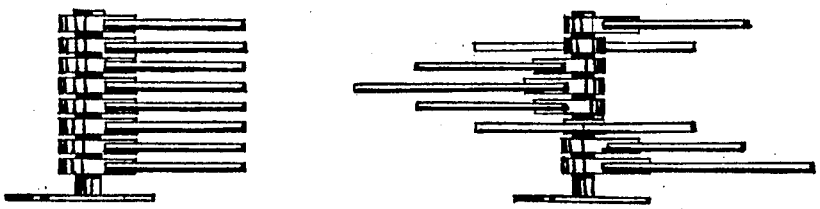
FIG. 3 is a side view of the device; the left hand portion of the figure shows the device from the side in its compact or closed form, while the right side of the drawing show the side view of the device in its opened form.

In the preferred embodiment of the invention, connecting means fit onto the central shaft and hold panels horizontally as shown in FIG. 1. The connectors can either be rotated, or suitably disengaged so that the panels may be maneuvered into a compact stack of minimum dimension as shown in FIGS. 2 and 3. The left side of FIG. 2 shows a plan view of the preferred device in its compact form, as if to carry it to a location, for storage, or for shipping. The left side of the drawing shows the plan view of the device folded out for use. FIG. 3 shows the corresponding side views of the two dispositions of the device. In addition, FIG. 2 shows the device provided with a pedestal type base, designed to allow a free-standing embodiment of the invention suitable for floor or table-top positions. The transformation of the device from its closed to its open form is accomplished via the connecting means which are designed to rotate freely about the central shaft in one embodiment; in another embodiment, the connector would be provided with locating pins to fix the relative angle between neighboring panels and to prevent rotation on the shaft, especially when the device is mounted on a wall and the panels are succeptible to movement due to the force of gravity.

Connecting means are not necessarily limited to holding a single panel. A double helical configuration would result when two panels are supported opposing each other but in the same plane. (see FIG. 4 dotted lines indicating a possible double helical position). The double helical pattern works when the panels are hoizontal or vertical.

FIG. 4 shows a general modification of the device. Essential components remain similar to the previous embodiment with the exception of the connecting means which hold sound absorbing panels in a vertical position with respect to the floor plane. This arrangement is advantageous particularly when the device is mounted flush with a vertical surface such as a wall and when, in that position, the helical array subtends an angle of 180 degrees when seen in top view.

For clarity in visualizing the device, the present embodiment is shown mounted with its central shaft memeber coaxially inserted through the hollow corner assembly of a typical office partition system in a position which is anticipated for most common usage, since the partition is strongest structurally at this point and since the device is strategically best located just above the top of partitions for absorption of unwanted sound. A second preferred mounting for the device uses the embedded slotted standards which are common to virtually every manufactured office partition. This is shown in FIG. 5 wherein the central shaft memeber can be mounted flush to the slotted standard at any height via special hardware design to correspond to the spacing and geometry of the slots. This mounting configuration can also be used to support the central shaft memeber when the device is located substantially above panel height and not over a corner partition support; the central shaft simply extends downward to engage 2 or more suitably spaced slots in any available embedded standard.

FIG. 6 shows a detail of the modified form of the device pictured in FIG. 5, wherein the central shaft member is configured to function as a continuous connecting means for the support of vertically oriented sound absorbers in spel channels which permit semi-permanent attachment and variable positioning with respect to the long axis of the central shaft. The shaft would be extruded with a series of continuous slots so designed as to hold panels in place by friction and to allow them also to slide vertically to any position.

Disclosure of the invention herein described represents preferred embodiments of the device with specific modifications; however, further variations thereof in form and construction are possible within the scope of the claims which follow.

I claim:

1. A portable adjustable absorber comprising: a plurality of sound absorbent panels; an equal plurality of connecting means capable of grasping at one or more points along their peripheries and of supporting rigidly outward in substantially cantilevered fashion said plurality of panels, and formed with a suitable circular opening for attachment; a central support means characterized by a cylindrical shaft of a diameter corresponding to that of the opening in each connecting means such that a stack of connecting means with absorbent panels attached thereto may be assembled and be freely rotatable about the axis of said central support means, thus forming an adjustable and collapsible helix of both variable pitch and exposure of surface area of absorptive material by rotation of said panels with respect to one another through any angle, therefore permitting control of total sound absorption, or the collapsing of the helix into a compact prismatic profile when all of said absorptive panels are stacked forming an overall minimum dimension of the device for storage or transport; and base means for support and positioning of the entire device as desired adjacent to any interior environmental enclosure surface.

2. A portable adjustable acoustic absorber as recited in claim 1 in which connecting means accomodate any standardized manufactured mineral fiber absorbent panels.

3. A portable adjustable acoustic absorber as recited in claim 1 in which connecting means are configured with indexing means to permit locking adjacent panels at fixed identical angles with respect to one another.

4. A portable adjustable acoustic absorber as recited in claim 1 in which said base means facilitates attachment of the central support means directly to the partition structure of standardized open-plan office workstation systems.

* * * * *